US011193701B2

(12) United States Patent
Sun et al.

(10) Patent No.: US 11,193,701 B2
(45) Date of Patent: Dec. 7, 2021

(54) HEAT EXCHANGER AND REFRIGERATION CYCLE APPARATUS

(71) Applicant: Mitsubishi Electric Corporation, Chiyoda-ku (JP)

(72) Inventors: Faming Sun, Chiyoda-ku (JP); Yoji Onaka, Chiyoda-ku (JP); Shigeyoshi Matsui, Chiyoda-ku (JP); Takamasa Uemura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 81 days.

(21) Appl. No.: 16/606,321

(22) PCT Filed: Jun. 9, 2017

(86) PCT No.: PCT/JP2017/021493
§ 371 (c)(1),
(2) Date: Oct. 18, 2019

(87) PCT Pub. No.: WO2018/225252
PCT Pub. Date: Dec. 13, 2018

(65) Prior Publication Data
US 2020/0300515 A1 Sep. 24, 2020

(51) Int. Cl.
*F25B 13/00* (2006.01)
*F25B 39/02* (2006.01)
(Continued)

(52) U.S. Cl.
CPC ..... *F25B 39/02* (2013.01); *F25B 47/02* (2013.01); *F25B 2313/02741* (2013.01);
(Continued)

(58) Field of Classification Search
CPC ..... F25B 39/02; F25B 39/00; F25B 41/00; F25B 47/02; F25B 2313/02741;
(Continued)

(56) References Cited

U.S. PATENT DOCUMENTS

2003/0209344 A1 11/2003 Fang et al.
2013/0014540 A1 1/2013 Mitchitsuji
(Continued)

FOREIGN PATENT DOCUMENTS

DE 102015105093 A1 * 10/2015 ..... F28D 1/0417
JP 54-26762 U 2/1979
(Continued)

OTHER PUBLICATIONS

The attached pdf file is the translation of the foreign reference JP2016084993A (Year: 2016).*
(Continued)

*Primary Examiner* — Henry T Crenshaw
*Assistant Examiner* — Kamran Tavakoldavani
(74) *Attorney, Agent, or Firm* — Xsensus LLP

(57) ABSTRACT

A heat exchanger includes a plurality of heat transfer tubes arranged at predetermined intervals in a vertical direction, a tubular header that has a plurality of connection portions where the heat transfer tubes are connected to a side portion of the header and that communicates with each of the heat transfer tubes, a refrigerant pipe that communicates with the header at a middle portion of the header in the vertical direction, and a first bypass pipe having ends one of which communicates with a lower portion of the header and the other of which communicates with a middle portion of the refrigerant pipe. A distance between a communication position at which the first bypass pipe and the refrigerant pipe communicate with each other and an inner wall of the header is not more than double an inside diameter of the refrigerant pipe.

7 Claims, 11 Drawing Sheets

(51) Int. Cl.
*F25B 47/02* (2006.01)
*F28D 21/00* (2006.01)
*F28F 9/02* (2006.01)

(52) U.S. Cl.
CPC .... *F28D 2021/0071* (2013.01); *F28F 9/0275* (2013.01); *F28F 2215/12* (2013.01); *F28F 2250/06* (2013.01)

(58) Field of Classification Search
CPC ..... F28F 27/02; F28F 2215/12; F28F 9/0275; F28D 1/05316; F28D 1/05366; F28D 2021/0071
See application file for complete search history.

(56) References Cited

U.S. PATENT DOCUMENTS

2015/0027161 A1* 1/2015 Ohtani ..... F25B 39/02 62/515
2018/0135901 A1* 5/2018 Hirai ..... F28F 9/0273

FOREIGN PATENT DOCUMENTS

JP 5-41318 U 6/1993
JP 2015-017738 A 1/2015
JP 2015-200478 A 11/2015
JP 2016-84993 A 5/2016
JP 2016084993 A * 5/2016 ..... F28D 1/053
JP 2016-148483 A 8/2016
WO 2011/135946 A1 11/2011

OTHER PUBLICATIONS

International Search Report dated Sep. 5, 2017 in PCT/JP2017/021493 filed on Jun. 9, 2017.
Japanese Office Action drafted on Jan. 29, 2018 in Japanese Patent Application No. 2017-555737 (with English language translation).
Extended European Search Report dated May 4, 2020 in European Patent Application No. 17912712.1, 7 pages.
Office Action dated Oct. 19, 2020, in corresponding Chinese patent Application No. 201780090541.X, 18 pages.
Office Action dated May 11, 2021 issued in corresponding CN patent application No. 201780090541.X (and English translation).
Office Action dated Jun. 25, 2021 issued in corresponding European patent application No. 17912712.1.
Office Action dated Oct. 8, 2021 in corresponding Chinese patent Application No. 201780090541.X.

* cited by examiner

HEAT EXCHANGER AND REFRIGERATION CYCLE APPARATUS

TECHNICAL FIELD

The present invention relates to a heat exchanger in which one end of each of a plurality of heat transfer tubes communicates with a header, and also to a refrigeration cycle apparatus including the heat exchanger.

BACKGROUND ART

In the past, a heat exchanger has been known which include a plurality of heat transfer tubes arranged at predetermined intervals in a vertical direction and a tubular header that communicates with each of the heat transfer tubes at a side portion of the header. In the case where such a heat exchanger operates as an evaporator at a low temperature, frost forms on a surface of the heat exchanger. In this case, the lower the position of part of the heat exchanger, the more easily frost forms on the part. Therefore, of proposed existing heat exchangers provided with a header with which each of heat transfer tubes communicates, a heat exchanger intended to improve its defrosting performance is present (see Patent Literature 1).

The heat exchanger described in Patent Literature 1 includes a plurality of heat transfer tubes that are elongated in cross section. The heat transfer tubes are arranged at predetermined intervals in a vertical direction. Of the heat transfer tubes, a plurality of heat transfer tubes located in a higher region are used as a main heat exchange unit and a plurality of transfer pipes located in a lower region are used as a sub heat exchange unit. Furthermore, the plurality of heat transfer tubes that form the main heat exchanger unit are divided into heat transfer tubes that form an intermediate main heat exchange unit located at a central portion, heat transfer tubes that form an upper main heat exchange unit located above the intermediate main heat exchange unit, and heat transfer tubes that forms a lower main heat exchange unit located below the intermediate main heat exchange unit. The plurality of heat transfer tubes that form the sub heat exchanger unit are divided into heat transfer tubes that form an intermediate sub heat exchange unit, heat transfer tubes that form an upper sub heat exchange unit located above the intermediate sub heat exchange unit, and heat transfer tubes that form a lower sub heat exchange unit located below the intermediate sub heat exchange unit.

An end of each of the above heat transfer tubes communicates with the header at in a side portion of the header. To be more specific, an internal space of the header is partitioned into an upper inflow and outflow space and a lower inflow and outflow space. Moreover, the end of each of the heat transfer tubes that form the main heat exchange unit communicates with the upper inflow and outflow space. The above end of each of the heat transfer tubes that form the sub heat exchange unit communicates with the lower inflow and outflow space. Further, the other end of each of the heat transfer tubes that form the intermediate main heat exchange unit communicates with the other end of an associated one of the heat transfer tubes that form the lower sub heat exchange unit. The other end of each of the heat transfer tubes that form the upper main heat exchange unit communicates with the other end of an associated one of the heat transfer tubes that form the intermediate sub heat exchange unit. The other end of each of the heat transfer tubes that form the lower main heat exchange unit communicates with the other end of an associated one of the heat transfer tubes that form the upper sub heat exchange unit.

Furthermore, a gas refrigerant pipe communicates with the upper inflow and outflow space of the header in such a position as to face the intermediate main heat exchange unit. This gas refrigerant pipe is a pipe that allows gas refrigerant to flow therethrough. Furthermore, a liquid refrigerant pipe communicates with the lower inflow and outflow space of the header in such a position as to face the intermediate sub heat exchange unit. This liquid refrigerant pipe is a pipe that allows liquid or two-phase gas-liquid refrigerant to flow therethrough.

That is, in the case where the heat exchanger described in Patent Literature 1 operates as a condenser or a defrosting operation of the heat exchanger is performed, high-temperature and high-pressure gas refrigerant obtained by compression by a compressor flows into the upper inflow and outflow space of the header from the gas refrigerant pipe. This gas refrigerant having flowed into the upper inflow and outflow space of the header passes through the heat transfer tubes that form the main heat exchange unit and the heat transfer tubes that form the sub heat exchange unit, to change into, for example, liquid refrigerant, and the liquid refrigerant then flows into the lower inflow and outflow space of the header. Then, the refrigerant having flowed into the lower inflow and outflow space of the header flows to the outside of the heat exchanger from the liquid refrigerant pipe.

In the heat exchanger described in Patent Literature 1, as described above, the gas refrigerant pipe communicates with the upper inflow and outflow space of the header in such a position as to face the intermediate main heat exchange unit. Therefore, a larger amount of high-temperature and high-pressure gas refrigerant having flowed into the upper inflow and outflow space of the header flows through the intermediate main heat exchange unit of the main heat exchange unit. That is, a larger amount of high-temperature and high-pressure gas refrigerant can be made to flow through the lower sub heat exchange unit, which communicates with the intermediate main heat exchange unit. Therefore, the heat exchanger described in Patent Literature 1 can cause a larger amount of high-temperature and high-pressure gas refrigerant to flow through a lower portion of the heat exchanger, in which frost easily forms, and its defrosting performance is therefore improved.

CITATION LIST

Patent Literature

Patent Literature 1: Japanese Unexamined Patent Application Publication No.
2016-148483

SUMMARY OF INVENTION

Technical Problem

In the heat exchanger described in Patent Literature 1, as described above, the header and the plurality of heat transfer tubes communicate with each other in order to improve the defrosting performance of lower part of the heat exchanger. Therefore, when the heat exchanger described in Patent Literature 1 operates as an evaporator, a pressure loss is increased and thus great. Furthermore, in a refrigerant circuit of a refrigeration cycle apparatus, refrigerating machine oil that lubricates a slide part or other parts of the compressor circulates along with refrigerant. When the heat exchanger described in Patent Literature 1 operates as an evaporator, lubricating oil tends to stay in a lower region of the upper inflow and outflow space of the header.

More specifically, in the case where the heat exchanger described in Patent Literature 1 operates as an evaporator, two-phase gas-liquid refrigerant expanded by an expansion valve flows into the lower inflow and outflow space of the header from the liquid refrigerant pipe. Then, the two-phase gas-liquid refrigerant having flowed into the lower inflow and outflow space flows into the sub heat exchange unit. It should be noted that as described above, the liquid refrigerant pipe communicates with the lower inflow and outflow space of the header in such a position as to face the intermediate sub heat exchange unit. Therefore, a larger amount of refrigerant flows into the intermediate sub heat exchange unit.

That is, in the main heat exchange unit, a larger amount of refrigerant flows in the upper main heat exchange unit, which communicates with the intermediate sub heat exchange unit. Therefore, in the upper inflow and outflow space of the header, the flow rate of refrigerant that flows out from the upper main heat exchange unit into the gas refrigerant pipe increases. It should be noted that the refrigerant that flows in the header flows through part of the header where heat transfer tubes protrude and part of the header where no heat transfer tubes protrude. When the refrigerant flows through the above parts of the header, that is, parts having different areas in flow-passage cross section, the refrigerant expands and contracts, thus causing a pressure loss. Moreover, this pressure loss increases as the flow rate of the refrigerant increases. Therefore, in the upper inflow and outflow space of the header of the heat exchanger described in Patent Literature 1, the pressure loss increases in an area in which the refrigerant flows from the upper main heat exchange unit into the gas refrigerant pipe.

Furthermore, when refrigerant flows out from the main heat exchange unit to the upper inflow and outflow space of the header, refrigerating machine oil mixed in the refrigerant is separated therefrom. Then, the separated refrigerating machine oil drops into a lower region of the upper inflow and outflow space. At this time, as described above, in the upper inflow and outflow space, the flow rate of refrigerant that flows out from the upper main heat exchange unit into the gas refrigerant pipe increases. That is, in the upper inflow and outflow space, the flow rate of refrigerant that flows from an upper part of the gas refrigerant pipe to the gas refrigerant increases, and the flow rate of refrigerant that flows from a lower part of the gas refrigerant pipe to the gas refrigerant decreases. Thus, in the case of draining from the upper inflow and outflow space, the refrigerating machine oil separated from the refrigerant in the upper inflow and outflow space, the level of the draining function of the heat exchanger described in Patent Literature 1 is low, as a result of which the lubricating oil tends to stay in the lower portion of the upper inflow and outflow space.

The present invention has been made to solve the above problem. The first object of the invention is to provide a heat exchanger that includes a plurality of heat transfer tubes arranged at predetermined intervals in a vertical direction and a header that communicates with each of heat transfer tubes at a side portion of the header, that is capable of improving the defrosting performance and reducing a pressure loss, and also capable of reducing the amount of refrigerating machine oil staying. The second object of the invention is to provide a refrigeration cycle apparatus including the heat exchanger.

Solution to Problem

A heat exchanger according to an embodiment of the present invention includes: a plurality of heat transfer tubes arranged at predetermined intervals in a vertical direction; a tubular header including a side surface portion having a plurality of connection portions to which the heat transfer tubes are connected, the header communicating with each of the heat transfer tubes; a refrigerant pipe that communicates with the header at a middle portion of the header in the vertical direction; and a first bypass pipe having ends one of which communicates with a lower portion of the header and the other of which communicates with a middle portion of the refrigerant pipe. The distance between a communication position at which the first bypass pipe and the refrigerant pipe communicate with each other and an inner wall of the header is not more than double an inside diameter of the refrigerant pipe.

Advantageous Effects of Invention

In the heat exchanger according to the embodiment of the present invention, in the case where the heat exchanger operates as an evaporator and a defrosting operation is performed, refrigerant is made to flow in a manner as described below, whereby the defrosting performance can be improved, the pressure loss can be reduce, and the amount of refrigerating machine oil staying can be reduced.

More specifically, in the heat exchanger according to the embodiment of the present invention, during the defrosting operation, it is appropriate that refrigerant is made to flow such that refrigerant having flowed from the refrigerant pipe into the header is distributed to the heat transfer tubes. During the defrosting operation, in the case where the refrigerant is made to flow in the above manner in the heat exchanger according to the embodiment of the present invention, high-temperature and high-pressure gas refrigerant compressed by a compressor first flows into the refrigerant pipe. Then, part of the gas refrigerant having flowed into the refrigerant pipe flows into a lower portion of the header through the first bypass pipe. Thereby, a larger amount of high-temperature and high-pressure gas refrigerant can be made to flow in heat transfer tubes located in a lower portion of the heat exchanger. Therefore, the heat exchanger according to the embodiment of the present invention can improve its defrosting performance.

Furthermore, in the case where the heat exchanger according to the embodiment of the present invention operates as an evaporator, it is appropriate that refrigerant is made to flow such that refrigerants having flowed out of respective heat transfer tubes join each other in the header. In such a case, in the case where the heat exchanger according to the embodiment of the present invention operates as an evaporator, a two-phase gas-liquid refrigerant having expanded through an expansion valve evaporates while flowing through the heat transfer tubes, and changes into gas refrigerant, and then flows into the header as the gas refrigerant. Then, part of the gas refrigerant having flowed into the header flows directly into the refrigerant pipe. Furthermore, another part of the gas refrigerant having flowed into the header flows into the refrigerant pipe through the first bypass pipe. Thus, in the heat exchanger according to the embodiment of the present invention, at an arbitrary position in the header, the flow rate of refrigerant can be reduced, as compared with the case where the first bypass pipe is not provided. Therefore, the heat exchanger according to the embodiment of the present invention can reduce a pressure loss that occurs in the header.

Furthermore, in the embodiment of the present invention, the distance between a communication position at which the first bypass pipe and the refrigerant pipe communicate with each other and the inner wall of the header is not more than double the inside diameter of the refrigerant pipe. By causing the first bypass pipe to communicate with the refrigerant pipe at the above position, a vortex region close to an inlet of the refrigerant pipe (the vicinity of a communication position with the header) can be reduced, and the flow rate of refrigerant that collides with an inner wall of the refrigerant pipe can be reduced. Therefore, the heat exchanger according to the embodiment of the present invention can also reduce a pressure loss that occurs in the refrigerant pipe.

Further, one of ends of the first bypass pipe communicates with the lower portion of the header. Therefore, in the case where refrigerant is made to flow in the above manner and the heat exchange according to the embodiment of the present invention operates as an evaporator, refrigerant present in the lower portion of the header flows into the refrigerant pipe through the first bypass pipe. Thus, by the refrigerant that passes through the first bypass pipe, refrigerating machine oil collected in the lower portion of the header can be transferred to the refrigerant pipe. That is, the refrigerating machine oil collected in the lower portion of the header can be re-circulated in a refrigerant circuit. Therefore, the heat exchanger according to the embodiment of the present invention can also reduce the amount of refrigerating machine oil remaining.

DESCRIPTION OF EMBODIMENTS

Embodiment 1

Figure 1:
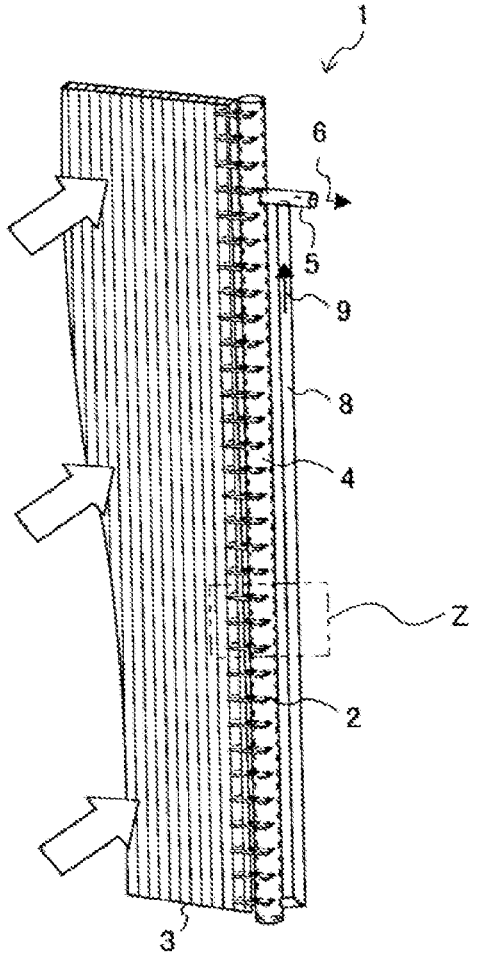
FIG. 1 is a perspective view illustrating a header of a heat exchanger according to Embodiment 1 of the present invention and the vicinity of the header.
Figure 2:
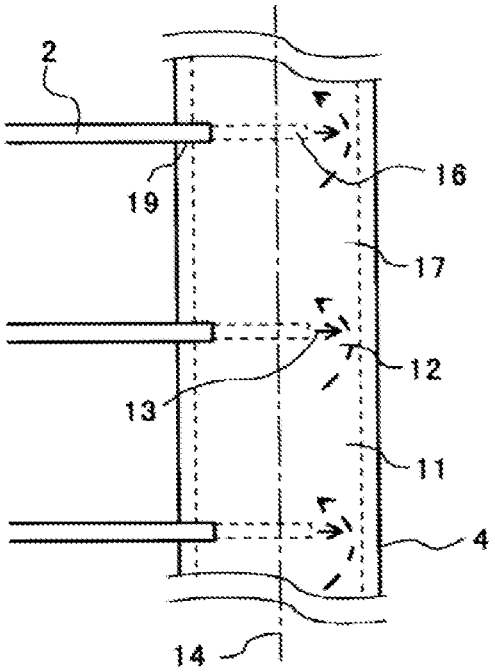
FIG. 2 is an enlarged side view of part Z of FIG. 1.
Figure 3:
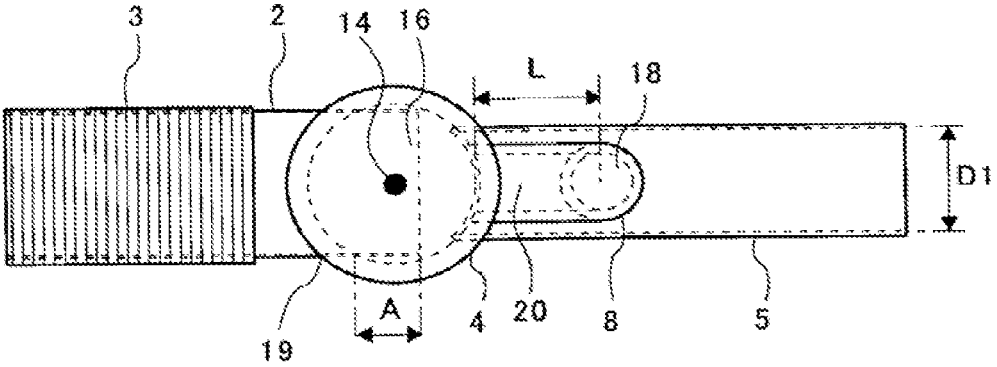
FIG. 3 is a bottom view illustrating the header of the heat exchanger according to Embodiment 1 of the present invention and the vicinity of the header.
Figure 4:
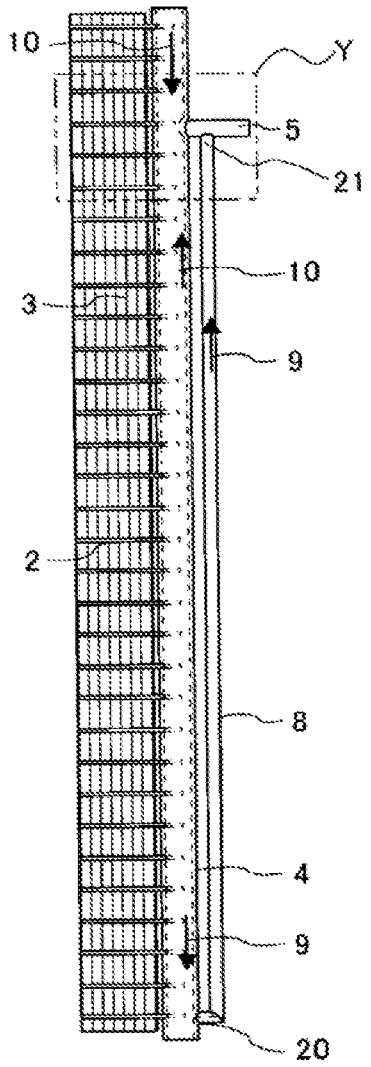
FIG. 4 is a side view illustrating the header of the heat exchanger according to Embodiment 1 of the present invention and the vicinity of the header.
Figure 5:
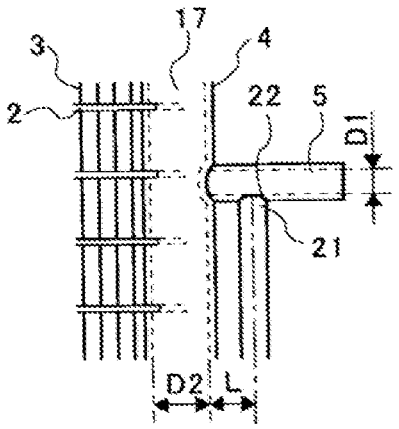
FIG. 5 is an enlarged side view of part Y of FIG. 4.

FIG. 1 is a perspective view illustrating a header of a heat exchanger according to Embodiment 1 of the present invention and the vicinity of the header. FIG. 2 is an enlarged side view of part Z in FIG. 1. FIG. 3 is a bottom view illustrating the header of the heat exchanger according to Embodiment 1 of the present invention and the vicinity of the header. FIG. 4 is a side view illustrating the header of the heat exchanger according to Embodiment 1 of the present invention and the vicinity of the header. FIG. 5 is an enlarged side view of part Y in FIG. 4. It should be noted that outlined arrows in FIG. 1 indicate the flow direction of air that is sent from a fan to a heat exchanger 1.

The heat exchanger 1 according to Embodiment 1 includes a plurality of heat transfer tubes 2 through which refrigerant flows, fins 3 joined to the heat transfer tubes 2, a header 4 that communicates with one end of each of the heat transfer tubes 2, a refrigerant pipe 5 that communicates with the header 4, and a first bypass pipe 8 through which the header 4 and the refrigerant pipe 5 communicate with each other. The header 4, the heat transfer tubes 2, the fins 3, the refrigerant pipe 5, and the first bypass pipe 8 may be made of aluminum and joined to each other by brazing.

In the heat transfer tubes 2, refrigerant flows. The heat exchanger 1 according to Embodiment 1 uses as the heat transfer tubes 2, flat pipes that are elongated in cross section. Each of the heat transfer tubes 2 extends in a lateral direction substantially perpendicular to the flow direction of air that is sent from the fan to the heat exchanger 1. Furthermore, the heat transfer tubes 2 are arranged at predetermined intervals in a vertical direction. Thus, air sent from the fan to the heat exchanger 1 flows into spaces between adjacent ones of the heat transfer tubes 2 through side portions of the heat transfer tubes. Then, the air sent from the fan to the heat exchanger 1 is heated or cooled by exchanging heat with the refrigerant flowing through the heat transfer tubes 2. It should be noted that the heat transfer tubers 2 are not limited to the flat pipes. For example, as the heat transfer tubes 2, circular pipes may be used. Further, it is not indispensable that the heat transfer tubes 2 are arranged at regular intervals. For example, it is assumed that one heat transfer tube 2 is a reference heat transfer tube, and of the heat transfer tubes 2 adjacent to the reference heat transfer tube, the heat transfer tube 2 located below the reference heat transfer tube is referred to as "lower heat transfer tube" and the heat transfer tube 2 located above the reference heat transfer tube is referred to as "upper heat transfer tube." In this case, the distance between the reference heat transfer tube and the lower heat transfer tube may be longer or shorter than that between the reference heat transfer tube and the upper heat transfer tube.

Each of the fins 3 is, for example, a plate fin formed in the shape of a cuboid that is longer in the vertical direction. The fins 3 are arranged at predetermined intervals in the lateral direction substantially perpendicular to the flow direction of air that is sent from the fan to the heat exchanger 1. Moreover, the heat transfer tubes 2 are joined to each of the fins 3 in such a manner as to extend through each fin 3. In other words, each of the heat transfer tubes 2 extends through each of the fins 3 in a direction in which the fins 3 are arranged. It should be noted that the fins 3 are not limited to the plate fins. For example, fins that are wavy in cross section may be used as the fins 3, and the fins 3 may be provided in respective spaces between adjacent ones of the heat transfer tubes 2 such that each of the fins 3 is in contact with associated ones of the heat transfer tubes 2. Furthermore, if it is ensured that the heat exchanger 1 can fulfill its heat exchange function without the fins 3, the fins 3 do not need to be provided.

The header 4 is a tubular element that extends in the vertical direction. In Embodiment 1, as the header 4, a circular tube is used. That is, the header 4 has an internal space 17 having a circular cross section. In other words, the internal space 17 of the header 4 has a flow passage having a circular cross section, that is, the internal space 17 has a circular flow-passage cross section. It should be noted that the flow-passage cross section of the flow passage of the internal space 17 of the header 4 is not limited to the circular one.

Figure 6:
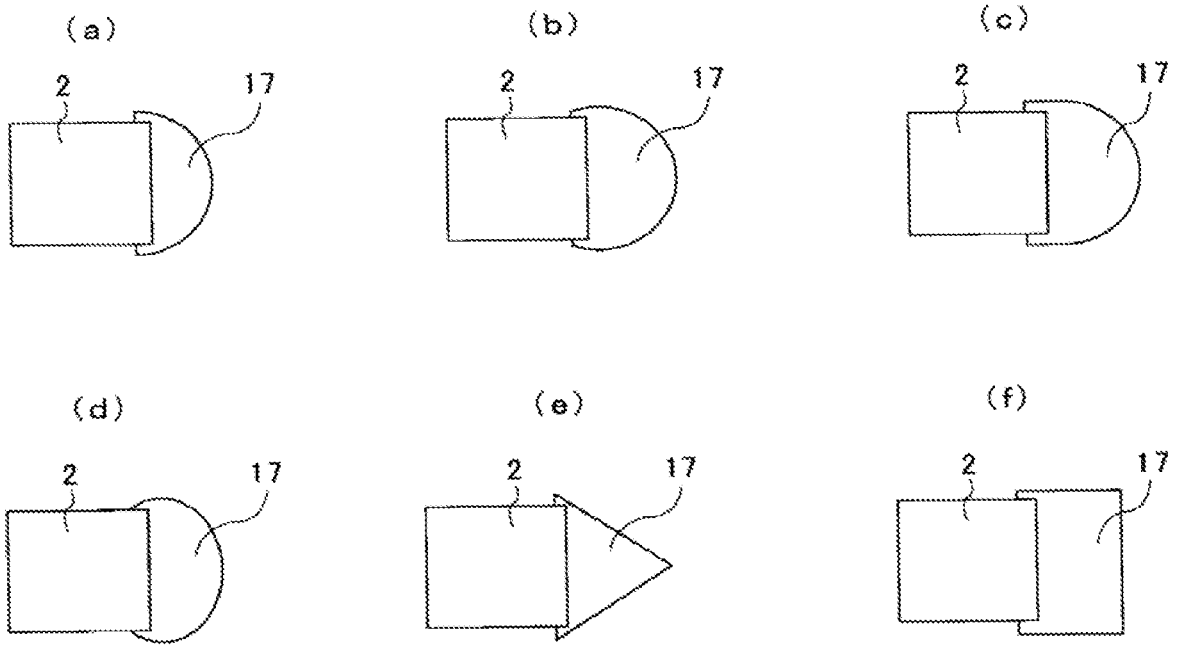
FIG. 6 illustrates other examples of a flow-passage cross sectional of an internal space of the header in Embodiment 1 of the present invention.

FIG. 6 illustrates other examples of the flow-passage cross section of the internal space of the header in Embodiment 1 of the present invention.

For example, as illustrated in FIG. 6, (a) and (b), the flow-passage cross section of the internal space 17 of the header 4 may have a shape (such as a semicircular shape) obtained by cutting out part of a circle. Alternatively, for example, as illustrated in FIG. 6, (c), the flow-passage cross section of the internal space 17 of the header 4 may have a D-shape. Alternatively, for example, as illustrated in FIG. 6, (d), the flow-passage cross section of the internal space 17 of the header 4 may have an elliptical shape. Alternatively, for example, as illustrated in FIG. 6, (e) and (f), the flow-passage cross section of the internal space 17 of the header 4 may have a polygonal shape.

In a side portion of the header 4, a plurality of through-holes 19 are formed at intervals in the vertical direction. In each of the through-holes 19, an end portion 16 of an associated one of the heat transfer tubes 2 is inserted. That is, the internal space 17 of the header 4 communicates with each of the heat transfer tubes 2. For example, each heat transfer tube 2 is inserted in an associated one of the through-holes 19 and is located substantially perpendicular to the side portion of the header 4. Furthermore, an edge portion of each of the through-holes 19 and an outer peripheral surface of the associated heat transfer tube 2 are joined to each other by brazing. That is, the header 4 is connected to the heat transfer tubes 2 by the edge portions of the through-holes 19.

It should be noted that the edge portions of the through-holes 19 correspond to connection portions of the present invention.

It should be noted that a brazing method of jointing the edge portion of a through-hole 19 and the outer peripheral surface of an associated heat transfer tube 2 to each other is not limited. For example, the following methods may be applied. First, a header 4 including through-holes 19 whose edge portions are coated with brazing filler metal is used, heat transfer tubes 2 are inserted into the through-holes 19 of the header 4, and the header 4 and the heat transfer tubes 2 are joined to each other by heating. Second, for example, heat transfer tubes 2 whose outer peripheral surfaces are coated with brazing filler metal is used, and the header 4 and the heat transfer tube 2 are joined to each other by heating after the heat transfer tubes 2 are inserted into the through-holes 19 of the header 4. Third, for example, the header 4 and the heat transfer tube 2 are joined to each other by heating after linearly shaped or ring-shaped brazing metal is provided close to the through holes, with the heat transfer tubes 2 inserted in the through-holes 19 of the header 4. Fourth, for example, the edge portions of the through-holes 19 are subjected to burring processing such that the edge portions of the through-holes 19 and the outer peripheral surfaces of the heat transfer tubes 2 are easily brazed to each other.

It should be noted that in the case where the heat transfer tubes 2 and the header 4 are connected as described above, regions where the end portions 16 of the heat transfer tubes 2 are located and regions where the end portions 16 of the heat transfer tubes 2 are not located are alternately located in the internal space 17 of the header 4 as illustrated in FIG. 2. The regions where the end portions 16 of the heat transfer tubes 2 are not located serve as flow-passage large portions 11 that are larger in cross section, that is, in flow-passage cross section, than the regions where the end portions 16 of the heat transfer tubes 2 are located. Furthermore, the regions where the end portions 16 of the heat transfer tubes 2 are located serves as flow-passage small portions 12 that are smaller in cross section, that is, in flow-passage cross section, than the regions where the end portions 16 of the heat transfer tubes 2 are not located. Refrigerant that flows through the internal space 17 of the header 4 alternately passes through the flow-passage large portions 11 and the flow-passage small portions 12 as indicated by dashed arrows in FIG. 2. At this time, a pressure loss occurs.

In an existing heat exchanger, in order to reduce this pressure loss, it is necessary to reduce the length A by which the end portion 16 of each of heat transfer tubes 2 is inserted in the internal space 17 (see FIG. 3 regarding the length A). If the end portion 16 of each heat transfer tube 2 is not sufficiently inserted into the internal space 17, that is, if the end portion 16 of each heat transfer tube 2 is not sufficiently inserted into an associated one of the through-holes 19 of the header 4, a failure occurs in joining between the through-hole 19 of the header 4 and the heat transfer tube 2. For this reason, in the existing heat exchanger, in order to prevent occurrence of a failure in the joining between the header 4 and the heat transfer tube 2 while reducing the pressure loss in the header 4, it is necessary to reduce the variation between the positions of the end portions 16 of the heat transfer tubes 2. However, in order to reduce the variation between the positions of the end portions 16 of the heat transfer tubes 2, it is necessary to increase the accuracy of processing of the heat transfer tubes 2 in length and the accuracy of assembly of the heat transfer tubes 2 and the header 4. As a result, it is harder to manufacture the existing heat exchanger, thus increasing the cost of the heat exchanger.

By contrast, the heat exchanger 1 according to Embodiment 1 includes the first bypass pipe 8, and can thus reduce a pressure loss that occurs in the internal space 17 of the header 4, as described later. Therefore, in the heat exchanger 1 according to Embodiment 1, the variation between the positions of the respective end portions 16 of the heat transfer tubes 2 is allowed to be greater than that in the existing heat exchanger. For example, as illustrated in FIG.

3, at least one of the plurality of heat transfer tubes 2 may be inserted in the internal space 17 up to a position farther from an associated through-hole 19 (that is, a connected portion) than a center 14 of the internal space 17 (that is, the center of gravity in) in cross section. It should be noted that as illustrated in FIG. 6, the flow-passage cross section of the internal space of the header 4 is not limited to a circular one. In the case where the flow-passage cross section of the internal space of the header 4 is not circular, the above "center 14" means "the center of gravity".

In the heat exchanger 1 according to Embodiment 1, the variation between the positions of the end portions 16 of the heat transfer tubes 2 can be set greater than that in the existing heat exchanger. Therefore, the heat exchanger 1 can be more easily manufactured, and the cost of the heat exchanger 1 can be reduced.

The refrigerant pipe 5 is, for example, a circular pipe. That is, in Embodiment 1, the flow-passage cross section of the refrigerant pipe 5 is circular. The refrigerant pipe 5 communicates with the internal space 17 of the header 4 at a middle portion of the header 4 in the vertical direction. The refrigerant pipe 5 causes the heat exchanger 1 to connect (communicate) with another component in a refrigeration cycle apparatus.

It should be noted that the flow-passage cross section of the refrigerant pipe 5 is not limited to a circular one. Further, the communication position at which the refrigerant pipe 5 communicates with the header 4 is not limited to the position indicated in FIGS. 1 and 3 to 5. For example, referring to FIGS. 1 and 3 to 5, the refrigerant pipe 5 communicates with the internal space 17 of the header 4 at a higher position than a middle part of the header 4 in the vertical direction. This, however, is not limitative. The refrigerant pipe 5 may communicate with the internal space 17 of the header 4 at the middle portion of the header 4 in the vertical direction. Alternatively, the refrigerant pipe 5 may communicate with the internal space 17 of the header 4 at a lower position than the middle part of the header 4 in the vertical direction.

The first bypass pipe 8 is, for example, a circular pipe. That is, in Embodiment 1, the flow-passage cross section of an internal space 18 of the first bypass pipe 8 is circular. The first bypass pipe 8 has an end portion 20 that is located on one end side of the first bypass pipe 8 and that communicates with the internal space 17 of the header 4 at a lower position than part of the header 4 that communicates with the refrigerant pipe 5. To be more specific, the end portion 20 of the first bypass pipe 8 communicates with the internal space 17 of the header 4 at a lower portion of the header 4. It should be noted that the lower portion of the header 4 in which the end portion 20 communicates with the internal space 17 of the header 4 is located closer to bottom part of the internal space 17 than an intermediate position between middle part in the internal space 17 in the vertical direction and the bottom part of the internal space 17. Furthermore, for example, in the case where the overall height of the internal space 17 in the vertical direction is 100%, the lower portion of the header 4 may be set as a portion of the header 4 that is located from the bottom part of the internal space 17 to a location corresponding to 20% of the height from the bottom part. Furthermore, for example, in the case where thirty or more heat transfer tubes 2 are vertically arranged as illustrated in FIG. 4, the lower portion of the header 4 may be set as a portion of the header 4 that is located from part thereof connected to the sixth header transfer pipe 2 from the lowermost header transfer pipe 2 to the bottom of the header 4. Alternatively, for example, as illustrated in FIG. 4, the lower portion of the header 4 may be set as a portion of the header 4 that is located from part thereof connected to the lowermost heat transfer tube 2 to the bottom of the header 4. Alternatively, for example, the lower portion of the header 4 may be a bottom portion of the header 4. In addition, the first bypass pipe 8 has an end portion 21 that is located on another end side of the first bypass pipe 8 and that communicates with a middle portion 22 of the refrigerant pipe 5. It should be noted that the flow-passage cross section of the internal space 18 of the first bypass pipe 8 is not limited to a circular one.

Figure 7:
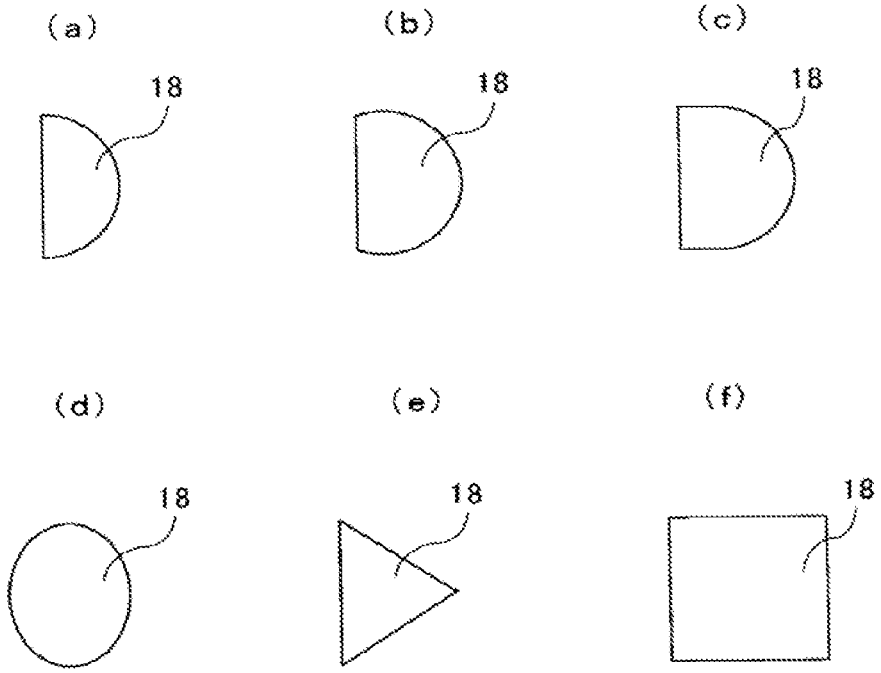
FIG. 7 illustrates diagrams illustrating other examples of the flow-passage cross sectional shape of an internal space of a first bypass pipe in Embodiment 1 of the present invention.

FIG. 7 illustrates other examples of the flow-passage cross section of the internal space of the first bypass pipe in Embodiment 1 of the present invention.

For example, as illustrated in FIG. 7, (a) and (b), the flow-passage cross section of the internal space 18 of the first bypass pipe 8 may have a shape (such as a semicircular shape) obtained by cutting off part of a circle. Alternatively, for example, as illustrated in FIG. 7, (c), the flow-passage cross section of the internal space 18 of the first bypass pipe 8 may have a D-shape. Alternatively, for example, as illustrated in FIG. 7, (d), the flow-passage cross section of the internal space 18 of the first bypass pipe 8 may have an elliptical shape. Alternatively, for example, as illustrated in FIG. 7, (e) and (f), the flow-passage cross section of the internal space 18 of the first bypass pipe 8 may have a polygonal shape.

Furthermore, the configuration in which the end portion 20 of the first bypass pipe 8 communicates with the header 4 is not limited to that illustrated in FIGS. 1, 3, and 4. For example, referring to FIGS. 1, 3, and 4, the end portion 20 of the first bypass pipe 8 communicates with the internal space 17 of the header 4 such that the end portion 20 of the first bypass pipe 8 is parallel to the axial direction of the heat transfer tubes 2. This, however, is not limitative. The end portion 20 of the first bypass pipe 8 may communicate with the internal space 17 of the header 4 such that the end portion 20 of the first bypass pipe 8 is not parallel to the tube axial direction of the heat transfer tubes 2 as seen in plan view. Further, for example, referring to FIGS. 1, 3, and 4, at the side portion of the header 4, the end portion 20 of the first bypass pipe 8 communicates with the internal space 17 of the header 4. This, however, is not limitative. In the bottom portion of the header 4, the end portion 20 of the first bypass pipe 8 may communicate with the internal space 17 of the header 4.

Furthermore, the configuration in which an end portion 21 of the first bypass pipe 8 with the refrigerant pipe 5 is not limited to that illustrated in FIGS. 1 and 3 to 5. For example, in FIGS. 1 and 3 to 5, the end portion 21 of the first bypass pipe 8 communicates with the refrigerant pipe 5 such that the end portion 21 of the first bypass pipe 8 is substantially perpendicular to a side portion of the refrigerant pipe 5. This, however, is not limitative. The end portion 21 of the first bypass pipe 8 may communicate with the refrigerant pipe 5 such that the end portion 21 of the first bypass pipe 8 is not substantially perpendicular to the side portion of the refrigerant pipe 5. Further, for example, referring to FIGS. 1 and 3 to 5, the end portion 21 of the first bypass pipe 8 communicates with the refrigerant pipe 5 from a location below the refrigerant pipe 5. This, however, is not limitative. The end portion 21 of the first bypass pipe 8 may communicate with the refrigerant pipe 5 from a location other than the location below the refrigerant pipe 5.

Furthermore, the end portion 21 of the first bypass pie 8 communicates with the refrigerant pipe 5 at such a position as described below. It should be noted that as indicated in FIGS. 3 and 5, D1 is the inside diameter of the refrigerant pipe 5, and L is the distance between a communication position at which the first bypass pipe 8 and the refrigerant pipe 5 communicate with each other and an inner wall of the header 4. The distance L between the communication position at which the first bypass pipe 8 and the refrigerant pipe 5 communicate with each other and the inner wall of the header 4 is not more than double the inside diameter D1 of the refrigerant pipe 5. It should be noted that the above communication position is the center of gravity in the cross section of the flow passage at the communication position. Further, in the case where the flow-passage cross section of the refrigerant pipe 5 is not circular, "equivalent diameter of the flow-passage cross section of the refrigerant pipe 5" is used as the above "inside diameter D1 of the refrigerant pipe 5".

It should be noted that an end portion of each heat transfer tube 2 which is opposite to the end portion 16 thereof is connected by a known component such as a known header to a component other than the heat exchanger 1 in the refrigeration cycle apparatus.

Next, an example of the refrigeration cycle apparatus including the heat exchanger 1 according to Embodiment 1 will be described. The refrigeration cycle apparatus according to Embodiment 1 employs the heat exchanger 1 as an evaporator. The following description is made by referring to by way of example the case where the heat exchanger 1 is used as an evaporator of an air-conditioning apparatus that is an example of the refrigeration cycle apparatus. It should be noted that needless to say, the heat exchanger 1 may be employed as an evaporator of a refrigeration cycle apparatus other than the air-conditioning apparatus, such as a hot-water supply device.

Figure 8:
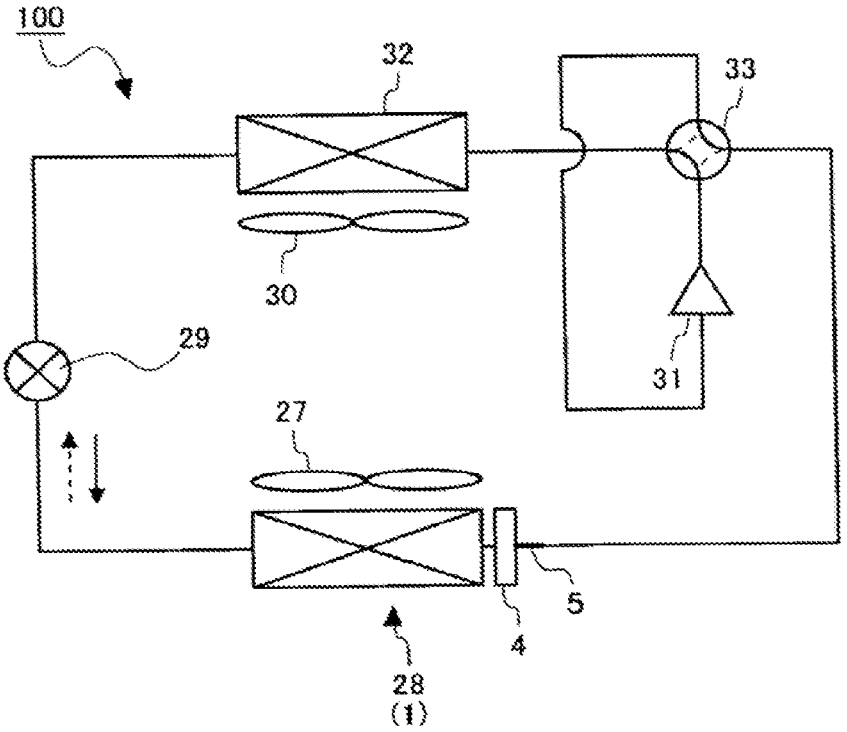
FIG. 8 is a refrigerant circuit diagram illustrating an air-conditioning apparatus according to Embodiment 1 of the present invention.

FIG. 8 is a refrigerant circuit diagram illustrating the air-conditioning apparatus according to Embodiment 1 of the present invention.

The air-conditioning apparatus 100 includes a compressor 31, an indoor heat exchanger 32, an indoor fan 30, an expansion valve 29, an outdoor heat exchanger 28, and an outdoor fan 27. The compressor 31, the indoor heat exchanger 32, the expansion valve 29, and the outdoor heat exchanger 28 are connected by pipes, whereby a refrigerant circuit is formed.

The compressor 31 compresses refrigerant. The refrigerant compressed by the compressor 31 is discharged therefrom, and then sent to the indoor heat exchanger 32. As the compressor 31, for example, a rotary compressor, a scroll compressor, a screw compressor, a reciprocating compressor, or other compressors can be used.

The indoor heat exchanger 32 operates as a condenser during a heating operation. When operating as a condenser, the indoor heat exchanger 32 communicates with a discharge port of the compressor 31. As the indoor heat exchanger 32, for example, a fin-and-tube heat exchanger, a microchannel heat exchanger, a shell and tube heat exchanger, a heat pipe heat exchanger, a double-pipe heat exchanger, a plate heat exchanger, or other heat exchangers can be used.

The expansion valve 29 expands refrigerant having passed through the indoor heat exchanger 32 to reduce the pressure of the refrigerant. It is appropriate that for example, an electrical expansion valve capable of adjusting the flow rate of refrigerant is used as the expansion valve 29. It should be noted that not only the electrical expansion device, but a mechanical expansion valve employing a diaphragm as a pressure receptor or other expansion valves can be applied as the expansion valve 29.

The outdoor heat exchanger 28 operates as an evaporator during a heating operation. The air-conditioning apparatus 100 according to Embodiment 1 employs a heat exchanger 1 as the outdoor heat exchanger 28. When the heat exchanger 1 operates as an evaporator, the end portion of each heat transfer tube 2 that is opposite to the end portion 16 communicates with the expansion valve 29. Furthermore, the refrigerant pipe 5 communicates with a suction port of the compressor 31.

The indoor fan 30 is provided close to the indoor heat exchanger 32, and supplies the indoor heat exchanger 32 with indoor air serving as a heat exchange fluid.

The outdoor fan 27 is provided close to the outdoor heat exchanger 28, and supplies the outdoor heat exchanger 28 with outdoor air serving as a heat exchange fluid.

Furthermore, in order that a cooling operation could be performed in addition to the heating operation, the air-conditioning apparatus 100 includes a flow passage switching device 33 provided on a discharge side of the compressor 31. The flow passage switching device 33 is, for example, a four-way valve. The flow passage switching device 33 causes the discharge port of the compressor 31 to communicate with the indoor heat exchanger 32 or the outdoor heat exchanger 28. That is, the flow passage switching device 33 switches the flow of refrigerant between the flow of refrigerant for the heating operation and the flow of refrigerant for the cooling operation. To be more specific, during the heating operation, the flow passage switching device 33 causes the discharge port of the compressor 31 to communicate with the indoor heat exchanger 32 and causes the suction port of the compressor 31 to communicate with the outdoor heat exchanger 28. During the cooling operation, the flow passage switching device 33 causes the discharge port of the compressor 31 to communicate with the outdoor heat exchanger 28 and causes the suction port of the compressor 31 to communicate with the indoor heat exchanger 32. That is, during the cooling operation, the indoor heat exchanger 28, that is, the heat exchanger 1, operates as a condenser, and the indoor heat exchanger 32 operates as an evaporator. When the heat exchanger 1 operates as a condenser, the end portion of each heat transfer tube 2 that is opposite to the end portion 16 communicates with the expansion valve 29. Furthermore, the refrigerant pipe 5 communicates with the discharge port of the compressor 31.

It should be noted that in the air-conditioning apparatus 100 according to Embodiment 1, the heat exchanger 1 is employed only as the outdoor heat exchanger 28. This, however, is not limitative. The heat exchanger 1 may be used not only as the outdoor heat exchanger 28, but as the indoor heat exchanger 32.

[Operation of Air-Conditioning Apparatus 100]

(Cooling Operation)

Next, the operation of the air-conditioning apparatus 100 will be described. First, the cooling operation of the air-conditioning apparatus 100 will be described. It should be noted that the flow of refrigerant during the cooling operation is indicted by the dashed arrow in FIG. 8.

When the compressor 31 is operated, high-temperature and high-pressure gas refrigerant is discharged from the compressor 31. The high-temperature and high-pressure gas refrigerant discharged from the compressor 31 flows into the outdoor heat exchanger 28, which operates as a condenser, via the flow passage switching device 33. In the outdoor heat exchanger 28, the high-temperature and high-pressure gas refrigerant having flowed thereinto and outdoor air supplied by the outdoor fan 27 exchange heat with each other. Then, the high-temperature and high-pressure gas refrigerant condenses to change into high-pressure liquid refrigerant.

To be more specific, the high-temperature and high-pressure gas refrigerant discharged from the compressor 31 flows from the refrigerant pipe 5 into the heat exchanger 1, which is the outdoor heat exchanger 28. Part of the high-temperature and high-pressure gas refrigerant having flowed into the refrigerant pipe 5 directly flows into the internal space 17 of the header 4. Further, another part of the high-temperature and high-pressure gas refrigerant having flowed into the refrigerant pipe 5 flows into lower part of the internal space 17 of the header 4 through the first bypass pipe 8. Then, the high-temperature and high-pressure gas refrigerant having flowed into the internal space 17 of the header 4 branches into parts, which flow into the respective heat transfer tubes 2. When the parts of the high-temperature and high-pressure gas refrigerant flows in the respective heat transfer tubes 2, they exchange heat with outdoor air sent by the outdoor fan 27 through surfaces of the heat transfer tubes 2 and surfaces of the fins 3. Thereby, the parts of the high-temperature and high-pressure gas refrigerant which flow in the heat transfer tubes 2 condense to change into high-pressure liquid refrigerant, and the high-pressure liquid refrigerant then flows out of the heat exchanger 1, that is, the outdoor heat exchanger 28.

After flowing out of the outdoor heat exchanger 28, the high-pressure liquid refrigerant is changed by the expansion valve 20 into low-pressure two-phase gas-liquid refrigerant. The two-phase refrigerant flows into the indoor heat exchanger 32, which operates as an evaporator. In the indoor heat exchanger 32, the two-phase refrigerant having flowed thereinto and indoor air sent by the indoor fan 30 exchange heat with each other, such that liquid refrigerant of the two-phase refrigerant evaporates to change into low-pressure gas refrigerant. Because of this heat exchange, the inside of a room is cooled. The low-pressure gas refrigerant sent out of the indoor heat exchanger 32 flows into the compressor 31 via the flow passage switching device 33, and is compressed into high-temperature and high-pressure gas refrigerant, and the high-temperature and high-pressure gas refrigerant is re-discharged from the compressor 31. Then, this cycle is repeated.

(Heating Operation)

Next, the heating operation of the air-conditioning apparatus 100 will be described. It should be noted that the flow of refrigerant during the heating operation is indicted by the solid arrow in FIG. 8.

When the compressor 31 is operated, a high-temperature and high-pressure gas refrigerant is discharged from the compressor 31. The high-temperature and high-pressure gas refrigerant discharged from the compressor 31 flows into the indoor heat exchanger 32, which operates as a condenser, via the flow passage switching device 33. In the indoor heat exchanger 32, the high-temperature and high-pressure gas refrigerant having flowed into the indoor heat exchanger 32 exchanges heat with indoor air sent by the indoor fan 30. Then, the high-temperature and high-pressure gas refrigerant condenses to change into high-pressure liquid refrigerant. Because of this heat exchange, the inside of the room is heated.

The high-pressure liquid refrigerant sent out from the indoor heat exchanger 32 is changed by the expansion valve 29 into low-pressure two-phase gas-liquid refrigerant. The two-phase refrigerant flows into the outdoor heat exchanger 28, which operates as an evaporator. In the outdoor heat exchanger 28, the two-phase refrigerant having flowed thereinto exchanges heat with outdoor air sent by the outdoor fan 27, such that liquid refrigerant of the two-phase refrigerant evaporates to change into low-pressure gas refrigerant.

To be more specific, the low pressure two-phase gas-liquid refrigerant into which the high-pressure liquid refrigerant is changed by the expansion valve 29 flows into each of the heat transfer tubes 2 of the heat exchanger 1, which serves as the outdoor heat exchanger 28, from the end portion of each heat transfer tube that is opposite to the end portion 16. When flowing through each heat transfer tube 2, the two-phase gas-liquid refrigerant exchanges heat with outdoor air sent by the outdoor fan 27 through the surface of the heat transfer tube 2 and the surface of the fin 3. Thereby, the two-phase gas-liquid refrigerant flowing through the heat transfer tubes 2 to change into low-pressure gas refrigerant. Then, as indicated by the arrows 13 in FIG. 2, the low-pressure gas refrigerant flows out from the end portions 16 of the heat transfer tubes 2 and join together in the internal space 17 of the header 4.

Part of single gas refrigerant which the gas refrigerants join each other to form in the internal space 17 of the header 4 directly flows into the refrigerant pipe 5 as indicated by the arrows 10 in FIG. 4. Furthermore, another part of the above single gas refrigerant flows into the refrigerant pipe 5 through the first bypass pipe 8 as indicated by the arrows 9 in FIG. 4. The gas refrigerant having flowed into the refrigerant pipe 5 flows out from the heat exchanger 1, that is, the outdoor heat exchanger 28 as indicated by the arrow 6 in FIG. 1.

The low-pressure gas refrigerant having flowed out of the outdoor heat exchanger 28 flows into the compressor 31 via the flow passage switching device 33, and is compressed into high-temperature and high-pressure gas refrigerant, and the high-temperature and high-pressure gas refrigerant is then re-discharged from the compressor 31. Thereafter, this cycle is repeated.

It should be noted that as described above, the gas refrigerant in the internal space 17 of the header 4 flows alternately through the flow-passage large portions 11 and the flow-passage small portions 12. When flowing in the internal space 17 of the header 4 in such a manner, the gas refrigerant is made alternately larger and smaller, thus causing a pressure loss. This pressure loss increases as the flow rate of the refrigerant increases. However, in the heat exchanger 1 according to Embodiment 1, part of the gas refrigerant having flowed into the internal space 17 of the header 4 flows into the refrigerant pipe 5 through the first bypass pipe 8. Therefore, at an arbitrary position in the internal space 17 of the header 4, the heat exchanger 1 according to Embodiment 1 can reduce the flow rate of the refrigerant, as compared with the case where the first bypass pipe 8 is not provided. To be more specific, in the heat exchanger 1 according to Embodiment 1, in a region of the internal space 17 of the header 4 where the gas refrigerant is made larger and smaller, at an arbitrary position in the internal space 17, the flow rate of the refrigerant can be reduced, as compared with the case where the first bypass pipe 8 is not provided. It is therefore possible to reduce the pressure loss that occurs at the header.

Furthermore, in the heat exchanger 1 according to Embodiment 1, the distance L between the communication position at which the first bypass pipe 8 and the refrigerant pipe 5 communicate with each other and the inner wall of the header 4 is not more than double the inside diameter D1 of the refrigerant pipe 5. Since the first bypass pipe 8 is made to communicate with the refrigerant pipe 8 at such a position, it is possible to reduce the pressure loss that occurs at the refrigerant pipe 5. It will be described in detail why the heat exchanger 1 according to Embodiment 1 can reduce the pressure loss that occurs in the refrigerant pipe 5.

Figure 9:
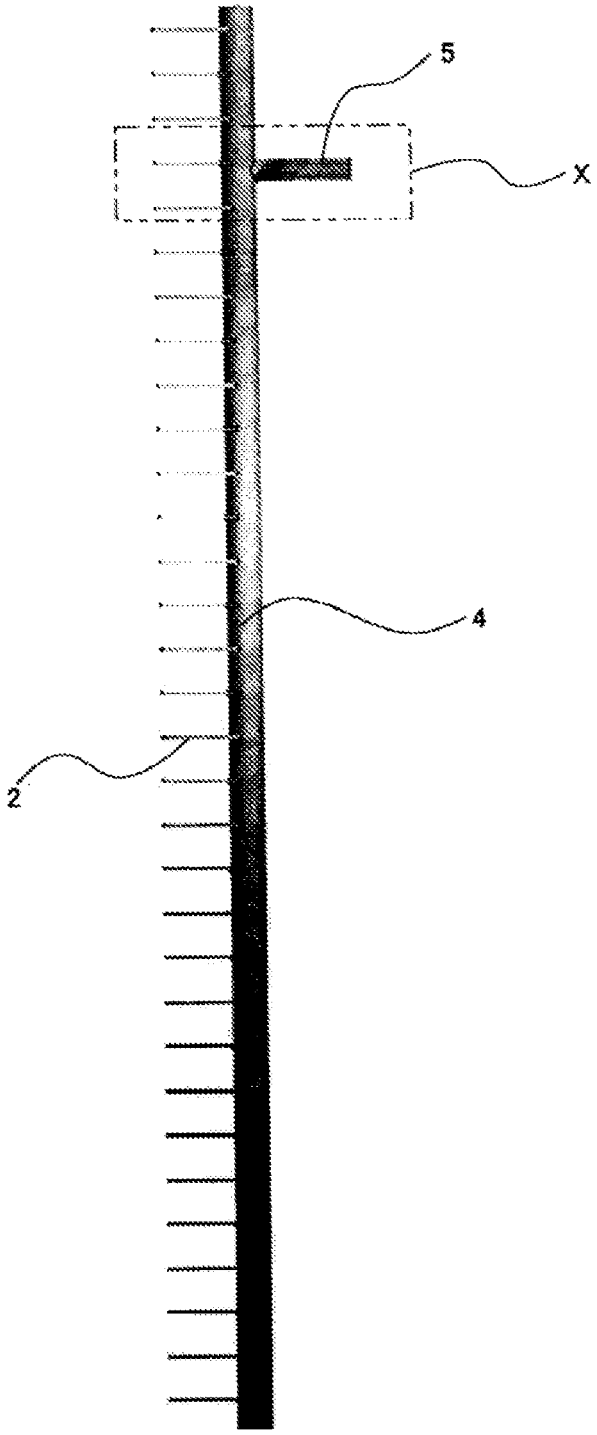
FIG. 9 is a diagram indicating a static pressure in each of the header and a refrigerant pipe in the case where a heat exchanger obtained by omitting the first bypass pipe from the heat exchanger according to Embodiment 1 of the present invention operates as an evaporator.
Figure 10:
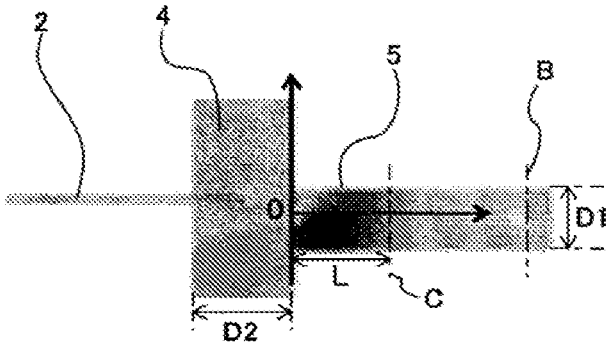
FIG. 10 is an enlarged view of part X of FIG. 9.
Figure 11:
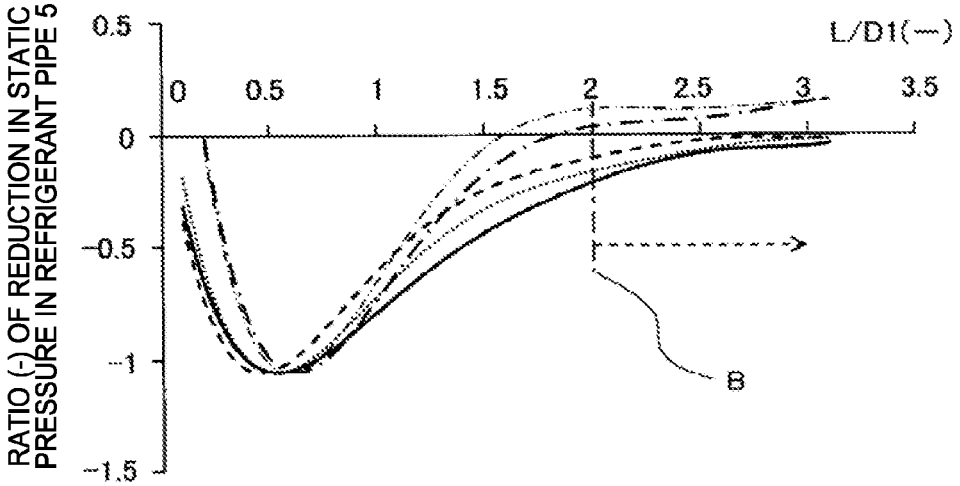
FIG. 11 is a diagram illustrating a relationship between a communication position at which the first bypass pipe and the refrigerant pipe communicate with each other and the static pressure in the refrigerant pipe in the heat exchanger according to Embodiment 1 of the present invention.

FIG. 9 is a diagram indicating a static pressure in each of the header and the refrigerant pipe in the case where a heat exchanger obtained by omitting the first bypass pipe from the heat exchanger according to Embodiment 1 of the present invention operates as an evaporator. FIG. 10 is an enlarged view of part X of FIG. 9. FIG. 11 illustrates a relationship between the communication position at which the first bypass pipe and the refrigerant pipe communicate with each other and the static pressure in the refrigerant pipe in the heat exchanger according to Embodiment 1 of the present invention. It should be noted that FIGS. 9 and 10 show that the darker the color, the lower the static pressure. Further, the vertical axis of FIG. 11 represents a reduction ratio of the static pressure in the refrigerant pipe 5. The horizontal axis of FIG. 11 represents the communication position as L/D1. The reduction ratio of the static pressure in the refrigerant pipe 5 is expressed by the following formula (1):

(The reduction ratio of the static pressure in the refrigerant pipe 5)={(the value of the static pressure in the refrigerant pipe 5 in the communication position *C* between the first bypass pipe 8 and the refrigerant pipe 5)−(the value of the static pressure in position *B* where the static pressure starts to stabilize in the refrigerant pipe 5)}÷{(the minimum value of the static pressure in the refrigerant pipe 5 in the case where the first bypass pipe 8 is not provided)−(the value of the static pressure in position *B* where the static pressure starts to stabilize in the refrigerant pipe 5)} (1)

It should be noted that FIG. 11 indicates the relationship between the communication position between the first bypass pipe 8 and the refrigerant pipe 5 and the static pressure in the refrigerant pipe 5 in the case where $0.5 \leq D1/D2 \leq 1$ is satisfied, where D2 is the inside diameter of the header 4. Further, in FIG. 11, as "the position B where the value of the static pressure starts to stabilize in the refrigerant pipe 5" in the formula 1, a position where the distance from the inner wall of the header 4 is double the inside diameter D1 of the refrigerant pipe 5 is adopted. Also, in FIG. 11, as "the minimum value of the static pressure in the refrigerant pipe 5 in the case where the first bypass pip 8 is not provided" in the formula 1, a value of the static pressure in a vortex region close to an inlet of the refrigerant pipe 5 (that is, a region close to the communication position with the header 4).

As illustrated in FIG. 11, no matter what value is obtained as D1/D2, the reduction ratio of the static pressure in the refrigerant pipe 5 decreases in the case where $L/D1 \leq 2$ is satisfied. That is, it can be seen that in the case where the distance L between the communication position between the first bypass pipe 8 and the refrigerant pipe 5 and the inner wall of the header 4 is not more than double the inside diameter D1 of the refrigerant pipe 5, it is possible to reduce the decrease of the static pressure in the refrigerant pipe 5. This is because it is possible to eliminate the vortex region close to the inlet of the refrigerant pipe 5 (that is, close to the communication point with the header 4), and reduce the flow rate of refrigerant that collides with an inner wall of the refrigerant pipe 5. Therefore, it is possible to reduce the pressure loss in the refrigerant pipe 5 by setting the distance L between the communication position between the first bypass pipe 8 and the refrigerant pipe 5 and the inner wall of the header 4 such that the distance L is double the inside diameter D1 of the refrigerant pipe 5.

Incidentally, the compressor 31 stores refrigerating machine oil that lubricates a slide portion such as a compression mechanism unit. When high-temperature and high-pressure gas refrigerant is discharged from the compressor 31, part of the refrigerating machine oil is mixed with the gas refrigerant and discharged from the compressor 31. As a result, the refrigerating machine oil circulates together with the refrigerant in the refrigerant circuit. Furthermore, part of the refrigerating machine oil that circulates in the refrigerant circuit may separate from the refrigerant before returning to the compressor 31, and stay in middle part of the refrigerant circuit. Then, when the amount of refrigerating machine oil that returns to the compressor 31 decreases to a small value, for example, a failure occurs in sliding of the compression mechanism unit, thus reducing the function and reliability of the compressor 1.

For example, during the heating operation, when low-pressure gas refrigerant flows from the end portion 16 of each of the heat transfer tubes 2 into the internal space 17 of the header 4 in the heat exchanger 1, which is the outdoor heat exchanger 28, refrigerating machine oil mixed in the gas refrigerant separates therefrom and drops into the lower part of the internal space 17 of the header 4. Consequently, the refrigerating machine oil easily collects in the lower part of the internal space 17 of the header 4.

However, in the heat exchanger 1 according to Embodiment 1, the end portion 20 of the first bypass pipe 8 communicates with the lower part of the internal space 17 of the header 4. That is, refrigerant present in the lower part of the internal space 17 of the header 4 flows into the refrigerant pipe 5 through the first bypass pipe 8. Thus, by the refrigerant passing through the first bypass pipe 8, the refrigerating machine oil collected in the lower part of the internal space 17 of the header 4 can be transferred to the refrigerant pipe 5. That is, the refrigerating machine oil collected in the lower part of the internal space 17 of the header 4 can be re-circulated in the refrigerant circuit. Therefore, in the heat exchanger 1 according to Embodiment 1, it is also possible to reduce the amount of the refrigerating machine oil remaining in the heat exchanger 1.

(Defrosting Operation)

During the heating operation, when the outside air temperature is low, moisture in the air may condense and adhere to the outdoor heat exchanger 28, which operates as an evaporator, and then freeze on the outdoor heat exchanger 28. That is, the outdoor heat exchanger 28 may be frosted. Therefore, the air-conditioning apparatus 100 is set to perform "defrosting operation" in order to remove frost adhering to the outdoor heat exchanger 28 during the heating operation.

The "defrosting operation" means an operation of supplying from the compressor 31, the outdoor heat exchanger 28, which operates as an evaporator, with high-temperature and high-pressure gas refrigerant, to thereby melt and remove frost adhering to the outdoor heat exchanger 28. In the air-conditioning apparatus 100 according to Embodiment 1, in the case where the defrosting operation is started, the flow passage switching device 33 switches the flow passage to the flow passage for the cooling operation. That is, during the defrosting operation, the refrigerant pipe 5 of the heat exchanger 1, which is the outdoor heat exchanger 28, communicates with the discharge port of the compressor 31.

Thereby, the high-temperature and high-pressure gas refrigerant discharged from the compressor 31 flow from the refrigerant pipe 5 into the heat exchanger 1. Then, part of the high-temperature and high-pressure gas refrigerant having flowed into the refrigerant pipe 5 flows into the lower part of the internal space 17 of the header 4 through the first bypass pipe 8. Therefore, in the heat exchanger 1 according to Embodiment 1, a larger amount of high-temperature and high-pressure gas refrigerant can be made to flow into heat transfer tubes 2 that are located in a lower portion of the heat exchanger 1 and are easily frosted. Therefore, the heat exchanger 1 according to Embodiment 1 can improve the defrosting performance.

As described above, the heat exchanger 1 according to Embodiment 1 includes the heat transfer tubes 2 arranged at predetermined intervals in the vertical direction, the tubular header 4 that has a plurality of connection portions (edges of through-holes 19) where the heat transfer tubes 2 are connected to the side portion of the header 4 and that communicates with each of the heat transfer tubes 2, the refrigerant pipe 5 that communicates with the header 4 at the middle portion of the header 4 in the vertical direction, and the first bypass pipe 8 whose end portion 20 communicates with the lower portion of the header 4 and whose end portion 21 communicates with the middle portion 22 of the refrigerant pipe 5. Furthermore, the distance L between the communication position at which the first bypass pipe 8 and the refrigerant pipe 5 communicate with each other and the inner wall of the header 4 is not more than double the inside diameter D1 of the refrigerant pipe 5.

Furthermore, the refrigeration cycle apparatus according to Embodiment 1, which is described above by way of example as the air-conditioning apparatus 100, is provided with a refrigerant circuit including the compressor 31, the condenser that is, for example, the indoor heat exchanger 32, the expansion valve 29, and the evaporator which is, for example, the outdoor heat exchanger 28, and uses the heat exchanger 1 according to Embodiment 1 as the evaporator. When the heat exchanger 1 operates as the evaporator, the refrigerant pipe 5 and a suction port of the compressor 31 communicate with each other. In addition, the refrigeration cycle apparatus according to Embodiment 1 includes the flow passage switching device 33 that is provided on the discharge side of the compressor 31, and causes the discharge port of the compressor 31 and the refrigerant pipe 5 of the heat exchanger 1 to communicate with each other during the defrosting operation.

In the case where the heat exchanger 1 according to Embodiment 1 operates as the evaporator, refrigerant is made to flow in the heat exchanger 1 in the direction indicated above regarding the refrigeration cycle apparatus according to Embodiment 1, thereby reducing the pressure loss in the heat exchanger 1. That is, the refrigeration cycle apparatus according to Embodiment 1 can reduce the decrease in the pressure of refrigerant that is sucked by the compressor 31, and improve the efficiency.

Also, in the case where the heat exchanger 1 according to Embodiment 1 operates as the evaporator, refrigerant is made to flow in the heat exchanger 1 in the direction indicated above regarding the refrigeration cycle apparatus according to Embodiment 1, thereby reducing the amount of refrigerating machine oil staying in the heat exchanger 1.

Furthermore, in the case of defrosting the heat exchanger 1 according to Embodiment 1, refrigerant is made to flow in the heat exchanger 1 in the direction indicated above regarding the refrigeration cycle apparatus according to Embodiment 1, thereby improving the defrosting performance of the heat exchanger 1.

In addition, because of provision of the first bypass pipe 8, the heat exchanger 1 according to Embodiment 1 can reduce the pressure loss that occurs in the internal space 17 of the header 4. Therefore, in the heat exchanger 1 according to Embodiment 1, the variation between the positions of the end portions 16 of the heat transfer tubes 2 can be set greater than that in the conventional heat exchanger. For example, as illustrated in FIG. 3, at least one of the plurality of heat transfer tubes 2 may be inserted in the internal space 17 up to a position farther from the through-hole 19 (i.e. the connection portion) than the center 14 of the internal space 17 in cross section. In the heat exchanger 1 according to Embodiment 1, since the variation between the positions of the respective end portions 16 of the heat transfer tubes 2 can be set greater than that in the conventional heat exchanger, it is possible to more easily manufacture the heat exchanger 1, and reduce the rise in the cost of the heat exchanger 1.

Furthermore, the heat exchanger 1 according to Embodiment 1 employs flat pipes as the heat transfer tubes 2. In the heat exchanger 1 employing flat pipes as the heat transfer tubes 2, the number of heat transfer tubes can be set larger than that of a heat exchanger 1 employing using circular pipes as heat transfer tubes 2. That is, the heat exchanger 1 employing flat pipes as the heat transfer tubes 2 includes a larger number of flow passages into which refrigerant branches and flows. Thus, in the heat exchanger 1 employing flat pipes as the heat transfer tubes 2, the flow rate of refrigerant in the lower portion of the header 4 is lower than in the heat exchanger 1 employing circular pipes as the heat transfer tubes 2, and refrigerating machine oil more easily collects in the lower portion of the header 4. Therefore, in the heat exchanger 1 according to Embodiment 1, which is highly effective in reduction of the amount of the refrigerating machine oil staying in the heat exchanger 1, it is particularly effective to employ flat pipes as the heat transfer tubes 2.

Embodiment 2

By adding to the heat exchanger 1 described above regarding Embodiment 1 a second bypass pipe 23 as described below, it is possible to further reduce the pressure loss in the heat exchanger 1. It should be noted that matters that are not particularly described regarding Embodiment 2 are the same as those of Embodiment 1, and functions and components which are the same as in Embodiment will be denoted by the same reference signs.

Figure 12:
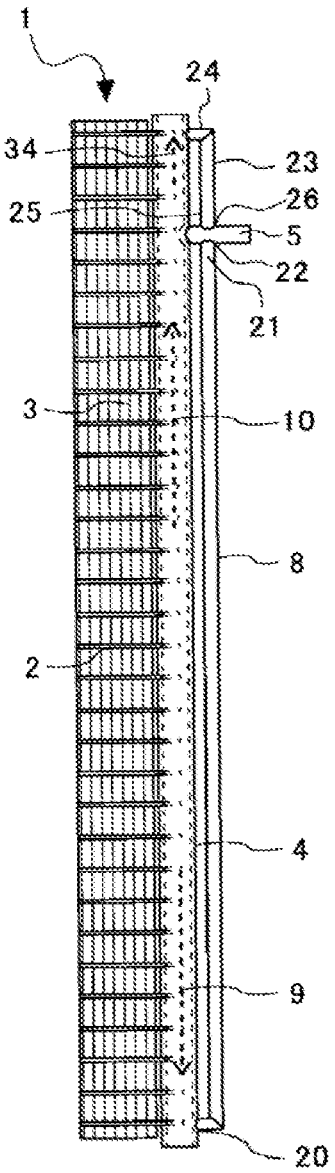
FIG. 12 is a side view illustrating a header of a heat exchanger according to Embodiment 2 of the present invention and the vicinity of the header.

FIG. 12 is a side view illustrating a header of a heat exchanger according to Embodiment 2 of the present invention and the vicinity of the header.

The second bypass pipe 23 is, for example, a circular pipe. That is, in Embodiment 2, the flow-passage cross section of the second bypass pipe 23 is circular. The second bypass pipe 23 has an end portion 24 that is located on one end side and that communicates with the internal space 17 of the header 4 at a position located above part of the header 4 that communicates with the refrigerant pipe 5. To be more specific, the end portion 24 of the second bypass pipe 23 communicates with the internal space 17 of the header 4 at an upper portion of the header 4.

Further, the second bypass pipe 23 has an end portion 25 that is located on the other end side thereof and that communicates with a middle portion 26 of the refrigerant pipe 5. To be more specific, where L2 is the distance between a communication position at which the second bypass pipe 23 and the refrigerant pipe 5 communicate with each other and the inner wall of the header 4, the distance L2 is not more than double the inside diameter D1 of the refrigerant pipe 5. For example, where a communication position at which the first bypass pipe 8 and the refrigerant pipe 5 communicate with each other is a first communication position, and a communication position at which the second bypass pipe 23 and the refrigerant pipe 5 communicate with each other is a second communication position, the first bypass pipe 8 and the second bypass pipe 23 communicate with the refrigerant pipe 5 such that the first communication position and the second communication position are opposite to each other. It should be noted that the above communication position between the second bypass pipe 23 and the refrigerant pipe 5 is the center of gravity in the cross section of a flow passage at the communication position between the second bypass pipe 23 and the refrigerant pipe 5.

It should be noted that the flow-passage cross section of the second bypass pipe 23 is not limited to a circular one, as in the first bypass pipe 8.

Furthermore, a configuration in which the end portion 24 of the second bypass pipe 23 communicates with the header 4 is not limited to that illustrated in FIG. 12. For example, referring to FIG. 12, the end portion 24 of the second bypass pipe 23 communicates with the internal space 17 of the header 4 such that the end portion 24 of the second bypass pipe 23 is parallel to the axial direction of the heat transfer tubes 2. This, however, is not limitative. The end portion 24 of the second bypass pipe 23 may communicate with the internal space 17 of the header 4 such that the end portion 24 of the second bypass pipe 23 is not parallel to the axial direction of the heat transfer tubes 2 as seen in plan view. Also, for example, referring to FIG. 12, the end portion 24 of the second bypass pipe 23 communicates with the internal space 17 of the header 4 at the side portion of the header 4. This, however, is not limitative. The end portion 24 of the second bypass pipe 23 may communicate with the internal space 17 of the header 4 at the upper side portion of the header 4.

Moreover, a configuration in which the end portion 25 of the second bypass pipe 23 communicates with the refrigerant pipe 5 is not limited to that illustrated in FIG. 12, either. For example, referring to FIG. 12, the end portion 25 of the second bypass pipe 23 communicates with the refrigerant pipe 5 such that the end portion 25 of the second bypass pipe 23 is substantially perpendicular to the side portion of the refrigerant pipe 5. This, however, is not limitative. The end portion 25 of the second bypass pipe 23 may communicate with the refrigerant pipe 5 such that the end portion 25 of the second bypass pipe 23 is not substantially perpendicular to the side portion of the refrigerant pipe 5. In addition, for example, referring to FIG. 12, the end portion 25 of the second bypass pipe 23 communicates with the refrigerant pipe 5 from an upper side of the refrigerant pipe 5. This, however, is not limitative. The end portion 25 of the second bypass pipe 23 may communicate with the refrigerant pipe 5 from part of the refrigerant pipe 5 that is other than the upper side of the refrigerant pipe 5. Further, the first bypass pipe 8 and the second bypass pipe 23 may communicate with the refrigerant pipe 5 such that the first communication position and the second communication position are not opposite to each other.

In the heat exchanger 1 according to Embodiment 2, gas refrigerant having flowed from the heat transfer tubes 2 into the upper part of the internal space 17 of the header 4 flows into the refrigerant pipe 5 through the second bypass pipe 23 as indicated by the arrow 34 in FIG. 12. Therefore, at an arbitrary position in the internal space 17 of the header 17, the heat exchanger 1 according to Embodiment 2 can further reduce the flow rate of the refrigerant, as compared with the heat exchanger 1 according to Embodiment 1. To be more specific, in a region of the internal space 17 of the header 4 where the gas refrigerant is made larger and smaller, not matter which part of the region of the internal space 17 is checked, the heat exchanger 1 according to Embodiment 2 can further reduce the flow rate of the refrigerant, as compared with the heat exchanger 1 according to Embodiment 1. Therefore, in addition to the advantage as described with respect to Embodiment 1, the heat exchanger 1 according to Embodiment 2 can further reduce the pressure loss that occurs in the header 4. That is, the refrigeration cycle apparatus according to Embodiment 2 can further reduce the decrease in the pressure of refrigerant that is sucked by the compressor 31, and can further improve the efficiency, as compared with the refrigeration cycle apparatus according to Embodiment 1.

Embodiment 3

In Embodiment 1, the header 4 and the first bypass pipe 8 include respective components and are formed as separate elements. This, however, is not limitative. The header 4 and the first bypass pipe 8 may be formed integral with each other. Furthermore, in the case where the heat exchanger 1 includes a second bypass pipe 23 as illustrated regarding Embodiment 2, the header 4, the first bypass pipe 8, and the second bypass pipe 23 may be formed integral with each other. It should be noted that matters that are not particularly described regarding Embodiment 3 are the same as those of Embodiment 1 or 2, and functions and components which are the same as those of any of the above embodiments are described by the same reference signs.

Figure 13:
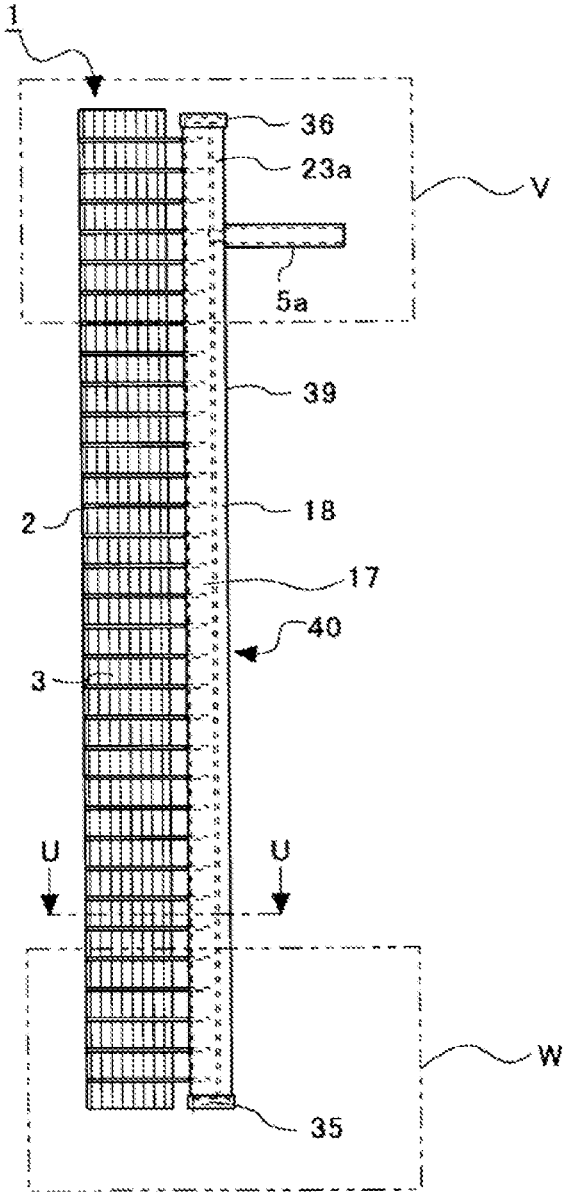
FIG. 13 is a side view illustrating a header of a heat exchanger according to Embodiment 3 of the present invention and the vicinity of the header.
Figure 14:
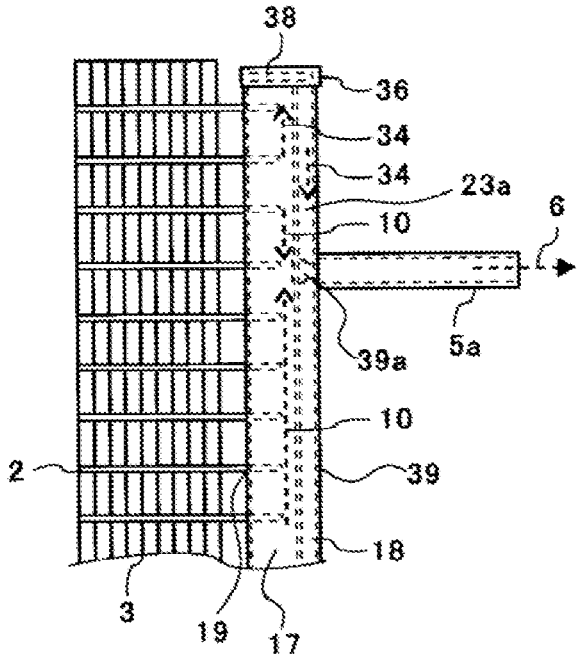
FIG. 14 is an enlarged side view of part V of FIG. 13.
Figure 15:
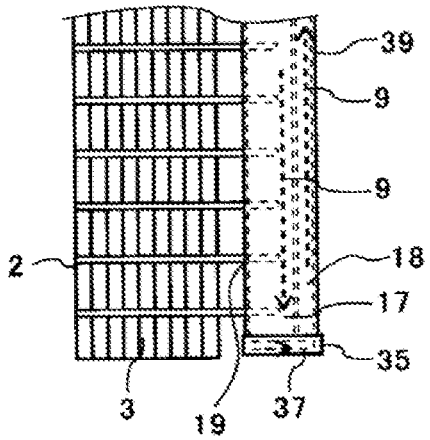
FIG. 15 is an enlarged side view of part W of FIG. 13.

FIG. 13 is a side view illustrating a header of a heat exchanger according to Embodiment 3 of the present invention and the vicinity of the header. FIG. 14 is an enlarged side view of part V as illustrated in FIG. 13. FIG. 15 is an enlarged side view of part W as illustrated in FIG. 13.

A heat exchanger 1 according Embodiment 3 includes an integrated header 40 in which a header 4, a first bypass pipe 8, and a second bypass pipe 23 are formed integral with each other. This integrated header 40 includes a header body 39 and lids 35 and 36.

The header body 39 has a through-hole that extends through the header body 39 in a vertical direction to serve as the internal space 17 (flow passage) of the header 4. Furthermore, in a side portion of the header body 39, a plurality of through-holes 19 are formed at predetermined intervals in the vertical direction. In these through-holes 19, the end portions 16 of respective heat transfer tubes 2 are inserted. Thereby, the internal space 17 communicates with the heat transfer tubes 2. In the header body 39, a communication hole **39*a* is formed; and one of ends of the communication hole 39*a* is open at a side portion of the header body 39, and the other communicates with the internal space 17. This communication hole 39*a* corresponds to part of an internal space (flow passage) of the refrigerant pipe 5. The communication hole 39 has an opening with which a pipe 5*a* forming part of the refrigerant pipe 5** communicates.

Also, in the header body 39, a through-hole is formed; and one of ends of the through-hole is open at a lower end of the header body 39, and the other communicates with the communication hole **39*a*. This through-hole serves as the internal space 18 (flow passage) of the first bypass pipe 8. Furthermore, in the header body 39, another through-hole is formed; and one of ends of this through-hole is open at an upper end of the header body 39, and the other communicates with the communication hole 39***a*. This through-hole serves as an internal space 23*a* (flow passage) of the second bypass pipe 23. In Embodiment 3, the internal space 23*a* and the internal space 18 are formed in such a manner as to face each other as seen in plan view.

The lid 35 covers the lower end of the header body 39. In an upper portion of the lid 35, space 37 is formed to cause the internal spaces 17 and 18 to communicate with each other, with the lower end of the header body 39 covered with the lid 35.

The lid 36 covers the upper end of the header body 39. In a lower portion of the lid 36, space 38 is formed to cause the internal spaces 17 and 23*a* to communicate with each other, with the upper end of the header body 39 covered with the lid 36.

It should be noted that the outer shape of the header body 39 is not limited to a particular one.

Figure 16:
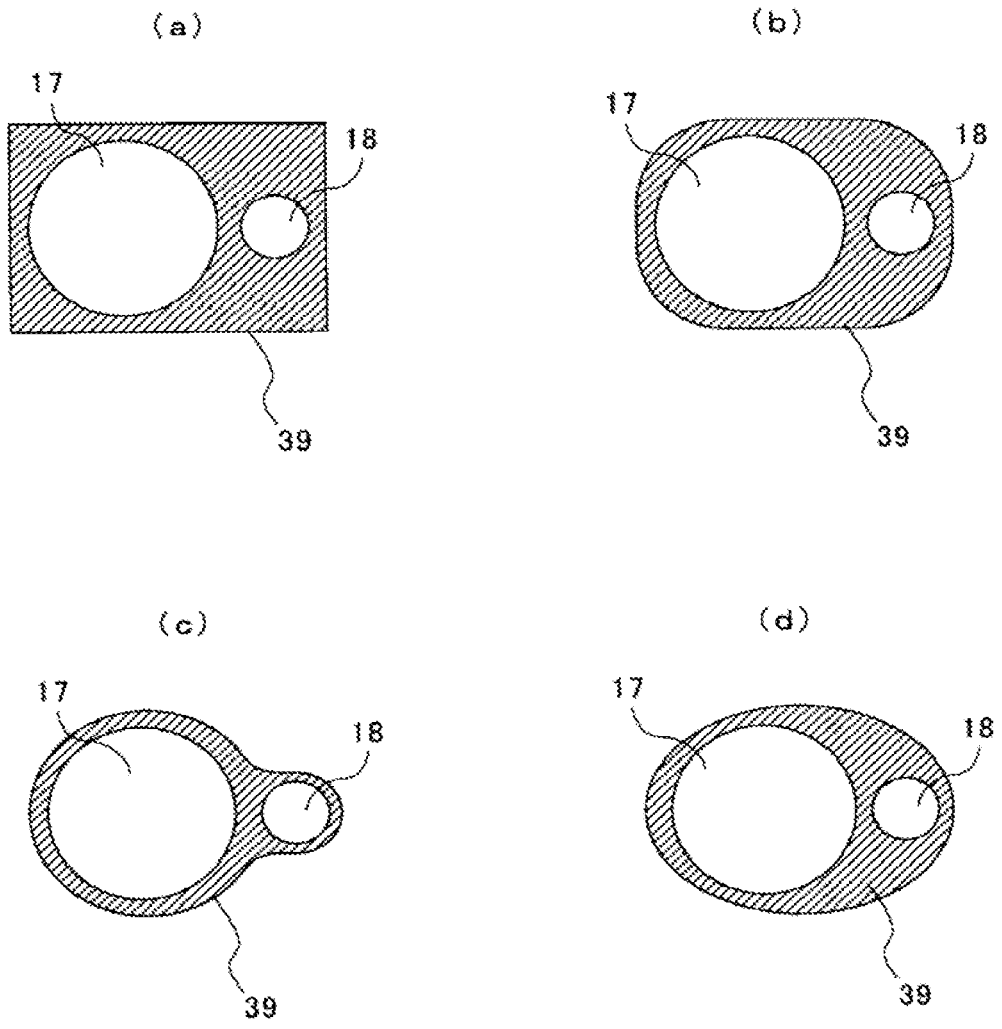
FIG. 16 illustrates cross-sectional views illustrating examples of the outer shape of a header body in Embodiment 3 of the present invention.

FIG. 16 illustrates cross sections as examples of the outer shape of the header body in Embodiment 3 of the present invention. To be more specific, FIG. 16 illustrates cross sections of the header body 39 which are taken along line U-U in FIG. 13.

For example, as illustrated in FIG. 16, (a) and (b), the outer shape of the header body 39 may be a quadrangular shape. In this case, as illustrated in FIG. 16, (b), the corners of the quadrangular shape may be formed in arc shapes or other shapes. Alternatively, for example, as illustrated in FIG. 16, (c), the outer shape of the header body 39 may be an 8-shape. Alternatively, for example, as illustrated in FIG. 16, (d), the outer shape of the header body 39 may be an elliptical shape.

Also, in the heat exchanger 1 including the integrated header 40 in which the first bypass pipe 8 and the second bypass pipe 23 are formed integral with each other, refrigerant flows in the same manner as in Embodiments 1 and 2.

For example, in the case where the heat exchanger 1 operates as an evaporator, low-pressure two-phase gas-liquid refrigerant flows into each of the heat transfer tubes 2 from an end portion of each heat transfer tube 2 that is opposite to the end portion 16. When flowing through each heat transfer tube 2, the two-phase gas-liquid refrigerant evaporates to change into low-pressure gas refrigerant. Then, parts of the low-pressure gas refrigerant flow out from the end portions 16 of the heat transfer tubes 2 and join each other in the interval space 17.

As indicated by the arrows 10 in FIG. 14, part of single gas refrigerant which the parts of the gas refrigerant join each other to form in the internal space 17 directly flows into the communication hole 39*a*, which corresponds to part of the refrigerant pipe 5. Furthermore, as indicated by the arrows 9 in FIG. 15, another part of the single gas refrigerant into which the gas refrigerants join each other to form in the internal space 17 flows into the communication hole 39*a*, which corresponds to part of the refrigerant pipe 5, through the space 37 and the internal space 18. Furthermore, as indicated by the arrows 34 in FIG. 14, still another part of the single gas refrigerant into which the gas refrigerants join each other in the internal space 17 flows into the communication hole 39*a*, which corresponds to part of the refrigerant pipe 5, through the space 38 and the internal space 23*a*. As indicated by the arrow 6 in FIG. 14, the gas refrigerant having flowed into the communication hole 39*a* flows out to the outside of the heat exchanger 1 from the pipe 5*a*, which forms part of the refrigerant pipe 5.

Further, for example, in the case where the heat exchanger 1 is defrosted, high-temperature and high-pressure gas refrigerant discharged from the compressor 31 flows into the heat exchanger 1 from the pipe 5*a*, which forms part of the refrigerant pipe 5. Then, part of the high-temperature and high-pressure gas refrigerant having flowed into the pipe 5*a* passes through the communication hole 39*a*, which forms part of the refrigerant pipe 5, and also through the internal space 18, and then flows into the lower part of the internal space 17. Thus, a larger amount of high-temperature and high-pressure gas refrigerant can be made to flow a heat transfer tube 2 or pipes 2 that are located in the lower portion of the heat exchanger 1, and are easily frosted.

As described above, also in the case where the heat exchanger 1 is configured as described above regarding Embodiment 3, refrigerant flows in the same way in Embodiments 1 and 2. Therefore, the heat exchanger 1 according to Embodiment 3 can also obtain the same advantages as those of the heat exchangers 1 according to Embodiments 1 and 2. Furthermore, in the heat exchanger 1 according to Embodiment 3, the header 4, the first bypass pipe 8, and the second bypass pipe 23 are integrally formed with each other. It is therefore possible to reduce the processing cost and assembly cost of peripheral components of the header, as compared with the heat exchangers 1 according to Embodiments 1 and 2. That is, in the heat exchanger 1 according to Embodiment 3, it is possible to reduce the cost of the heat exchanger 1, as compared with the heat exchangers 1 according to Embodiments 1 and 2.

REFERENCE SIGNS LIST heat exchanger 2 heat transfer tube 3 fin 4 header 5 refrigerant pipe 5*a* pipe 8 first bypass pipe 11 flow-passage large portion 12 flow-passage small portion 14 center 16 end portion 17 internal space 18 internal space 19 through-hole 20 end portion 21 end portion 22 middle portion 23 second bypass pipe 23*a* internal space 24 end portion 25 end 26 middle portion 27 outdoor fan 28 outdoor heat exchanger 29 expansion valve 30 indoor fan 31 compressor 32 indoor heat exchanger 33 flow-passage switching device 35 lid 36 lid 37 space 38 space 39 header body 39*a* communication hole 40 integrated header 100 air-conditioning apparatus

The invention claimed is:

1. A heat exchanger comprising:

a plurality of heat transfer tubes arranged at predetermined intervals in a vertical direction;

a tubular header including a side surface portion having a plurality of connection portions to which the heat transfer tubes are connected, the header communicating with each of the heat transfer tubes;

a refrigerant pipe that communicates with the header at a middle portion of the header in the vertical direction; and a first bypass pipe having ends one of which communicates with a lower portion of the header and the other of which communicates with a middle portion of the refrigerant pipe, wherein a distance between a communication position at which the first bypass pipe and the refrigerant pipe communicate with each other and an inner wall of the header is not more than double an inside diameter of the refrigerant pipe, and $$D1/D2 \leq 1,$$

where D1 is the inside diameter of the refrigerant pipe, and D2 is an inside diameter of the header.

2. The heat exchanger according to claim 1, wherein $$0.5 \leq D1/D2 \leq 1,$$

where D1 is the inside diameter of the refrigerant pipe, and D2 is an inside diameter of the header.

3. The heat exchanger according to claim 1, wherein each of the heat transfer tubes is connected to an associated one of the connection portions, with an end portion of the heat transfer tube inserted in an internal space of the header, and at least one of the plurality of heat transfer tubes is inserted in the internal space of the header up to a position farther from at least associated one of the connection portions than a center of gravity of the header in the internal space.

4. The heat exchanger according to claim 1, further comprising a second bypass pipe having ends one of which communicates with the header al a position located above a communication position at which the header and the refrigerant pipe communicate with each other and the other of which communicates with the middle portion of the refrigerant pipe.

5. The heat exchanger according to claim 1, wherein the header and the first bypass pipe are formed integral with each other.

6. The heat exchanger according to claim 1, wherein the heat transfer tubes are flat pipes that are elongated in cross section.

7. A refrigeration cycle apparatus comprising a refrigerant circuit including a compressor, a condenser, an expansion valve, and an evaporator, wherein the evaporator includes a heat exchanger including a plurality of heat transfer tubes arranged at predetermined intervals in a vertical direction, a tubular header including a side surface portion having a plurality of connection portions to which the heat transfer tubes are connected, the header communicating with each of the heat transfer tubes, a refrigerant pipe that communicates with the header at a middle portion of the header in the vertical direction, and a first bypass pipe having ends one of which communicates with a lower portion of the header and the other of which communicates with a middle portion of the refrigerant pipe, a distance between a communication position at which the first bypass pipe and the refrigerant pipe communicate with each other and an inner wall of the header being not more than double an inside diameter of the refrigerant pipe and $D1/D2 \leq 1$ where D1 is the inside diameter of the refrigerant pipe, and D2 is an inside diameter of the header, and when the heat exchanger operates as the evaporator, the refrigerant pipe and a suction port of the compressor communicate with each other, the refrigeration cycle apparatus further comprising a flow-passage switching valve provided on a discharge side of the compressor and configured to cause a discharge port of the compressor and the refrigerant pipe of the heat exchanger to communicate with each other during a defrosting operation.

* * * * *